US005358214A

United States Patent [19]

Batlle

[11] Patent Number: 5,358,214

[45] Date of Patent: Oct. 25, 1994

[54] MOLD FOR CONCRETE MODULAR PRECASTINGS

[76] Inventor: Juan B. Batlle, Vinya del Rei 3, 08328-Alella (Barcelona), Spain

[21] Appl. No.: 938,055

[22] PCT Filed: Feb. 5, 1992

[86] PCT No.: PCT/ES92/00013

§ 371 Date: Oct. 5, 1992

§ 102(e) Date: Oct. 5, 1992

[87] PCT Pub. No.: WO92/13690

PCT Pub. Date: Aug. 20, 1992

[30] Foreign Application Priority Data

Feb. 12, 1991 [ES] Spain ..... 9100360

[51] Int. Cl.[5] ..... B28B 3/00

[52] U.S. Cl. ..... 249/142; 249/9; 249/52; 249/101; 249/119; 249/131; 249/151; 249/176

[58] Field of Search ..... 249/5, 8, 9, 16, 52, 249/63, 64, 98, 101, 119, 124, 129, 131, 142, 151, 152, 158, 176, 178, 184, 177

[56] References Cited

U.S. PATENT DOCUMENTS

| | | | |
|---|---|---|---|
| 1,596,179 | 8/1926 | Heltzel | 249/9 |
| 1,948,213 | 2/1934 | Heltzel | 249/9 |
| 2,674,960 | 4/1954 | De Pasquale | 249/151 X |
| 3,273,205 | 9/1966 | Hanley | 249/52 X |
| 4,198,176 | 4/1980 | Bentz | 249/9 X |
| 4,533,111 | 8/1985 | Cousin et al. | 249/2 |

*Primary Examiner*—James C. Housel
*Assistant Examiner*—Harold Pyon
*Attorney, Agent, or Firm*—Staas & Halsey

[57] ABSTRACT

The mold is comprised of a bottom (4) wherein there are provided grooves (8) extending transversely between containment sidewalls (6); said sidewalls (6) have windows (14) which are aligned with the grooves (8) which preferably are delimited by the faces (10) of fillets (12) arranged in parallel, facing each other and fixed to the bottom (4) of the mold.

14 Claims, 4 Drawing Sheets

MOLD FOR CONCRETE MODULAR PRECASTINGS

BACKGROUND OF THE INVENTION

The present invention relates to a mold for concrete modular precastings comprising a bottom and containment side walls.

DESCRIPTION OF THE PRIOR ART

Molds for such precastings are known in which there are fixed strips adapted to form in the concrete precasting slots or other types of void space. Nevertheless, in the regularly known molds, stripping of the part from the mold causes serious problems, since the adherence thereof to the mold itself and to the said strips causes stresses to be formed in the precastings capable of causing a serious deterioration thereof. Independently of the above, mold stripping in the usually known systems requires a relatively long time.

SUMMARY OF THE INVENTION

It is an objective of the invention to provide a mold in which the drawbacks mentioned in the foregoing paragraph are overcome, namely, one which does not cause the said stresses and involves a shorter time.

This objective is attained by a mold of the type described at the beginning which is characterized in that in said bottom there are to be found a plurality of grooves extending transversely between both sidewalls, there being in said sidewalls windows the passage of which is an extension of the groove.

Preferably according to the invention, each groove is delimited by facing faces of respective fillets fixedly attached to the mold bottom and which are arranged spaced apart and parallel to one another.

According to another preferred feature of the invention, the dimensions of the window, perpendicular to the mold bottom, is greater than the depth or dimension in like direction of the groove.

In a development of the invention, the mold comprises strips adapted to engage in said grooves and these strips have a height greater than the depth of the grooves and are longer than the grooves and project out through the windows.

In a further development of the invention, said strips have a height smaller than the dimension of the windows in a direction perpendicular to the bottom of the mold, whereby they are adapted to move in said direction between a lowered position in which they rest against said bottom and a raised position in which they engage the upper profile of the window.

BRIEF DESCRIPTION OF THE DRAWINGS

Further advantages and features of the invention will be appreciated from the following description in which one preferred embodiment of the invention is described as a non-limitative example, with reference to the accompanying drawings, in which.

DETAILED DESCRIPTION OF THE INVENTION

The mold 2 of the present invention is for concrete modular precastings. The term modular is intended to describe fabricated pieces containing repeats of a module of certain dimensions and a module may consist of a piece independent from another module or two consecutive modules may be separated by a slot or the like.

Figure 1:
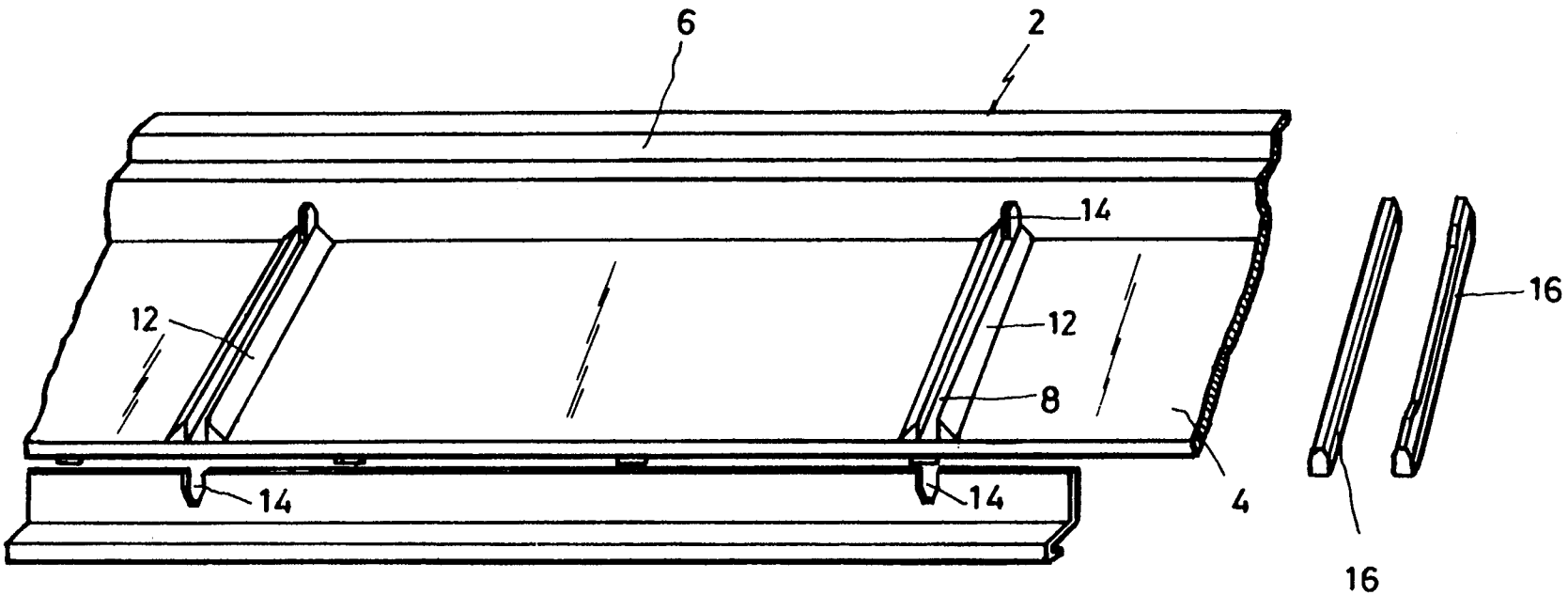
FIG. 1 is a part perspective view of the mold of the invention, with one side wall folded down.

The mold 2 is generally made of metal and comprises a bottom 4 and containment side walls 6, which may be folded down as shown in FIG. 1, although this is not the most frequent situation. The mold 2 may be of substantial size in the longitudinal direction, whereby a very large piece or a piece comprising a high number of modules may be formed. The side walls 6 do not of necessity define a straight line, but may have an appropriate form to allow the production of pieces of various shapes, such as hexagonal and the like.

Figure 4:
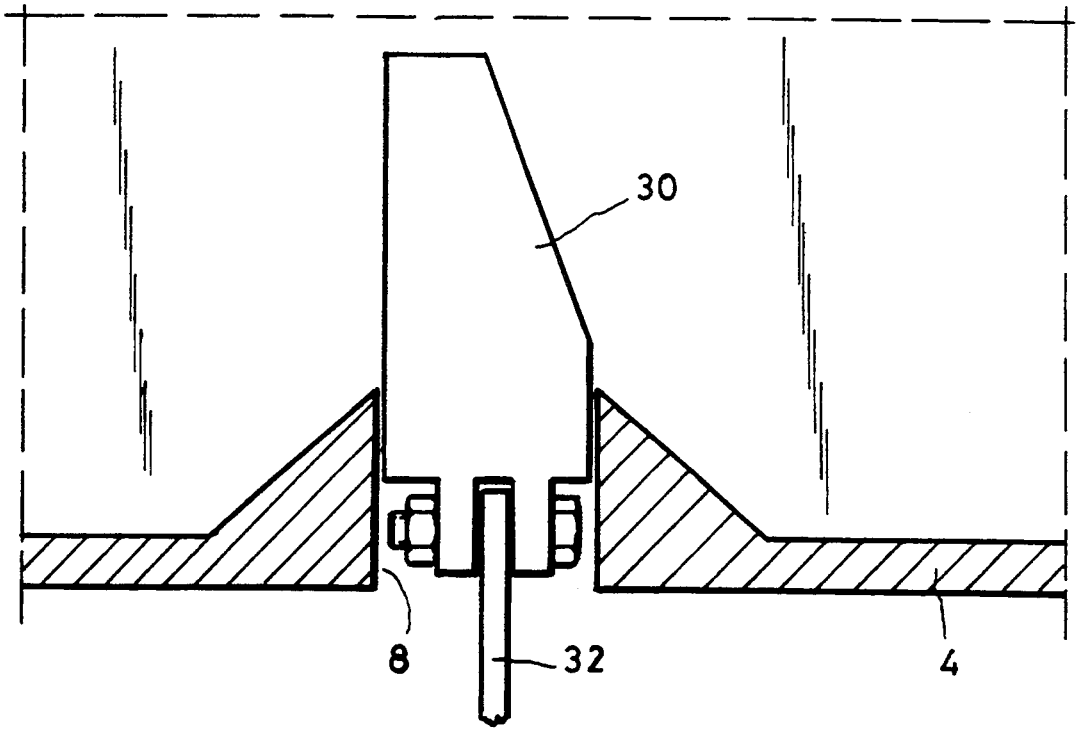
FIG. 4 is a partial elevation view of the mold having a through slot and a rule inserted therethrough.

According to the invention, the bottom 4 is formed with grooves which may be through slots (FIG. 4); they may consist of a recess formed in the bottom; or, preferably, the grooves 8 may delimited by the facing faces 10 of spaced apart, parallel fillets 12 fixedly attached to the bottom 4.

The fillets 12 are preferably prismatic in shape, more particularly they have the shape of a prism the right section of which is a right-angled triangle.

The side walls 6 are provided with windows 14, the passage of which is an extension of a groove 8, i.e. the windows 14 are aligned with a groove 8.

It is a preferred condition of the invention that the dimension of the windows 14 in a direction normal to the bottom 4 of the mold 2 (i.e. the height of the window) is greater than the depth (i.e. the dimension in the same perpendicular direction) of the groove 8.

Strips 16 may engage in said grooves such that they are adapted to be moved longitudinally (in the longitudinal direction of the groove 8) and also vertically. Preferably, the height of the strips 16 is greater than the depth of the grooves 8, whereby each strip projects from the corresponding groove, although such height is smaller than that of the side walls 6.

Under the above conditions, when the mole is filled with concrete, the resulting molded piece is provided with a slot, the shape of which is that of the fillets 12 and of the strip 16.

Figure 2:
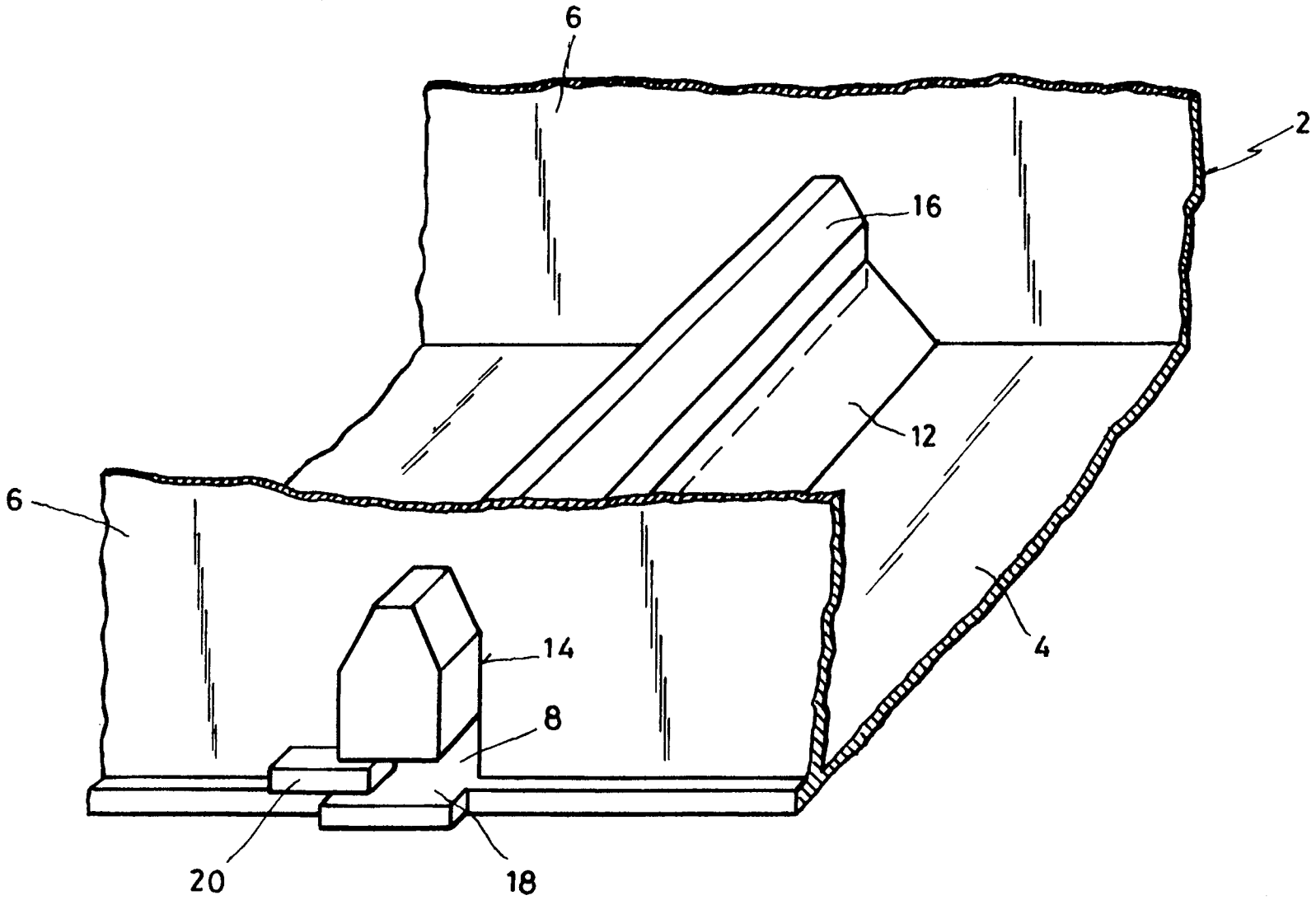
FIG. 2 is a part perspective view of the mold, showing a strip in the raised position.
Figure 3:
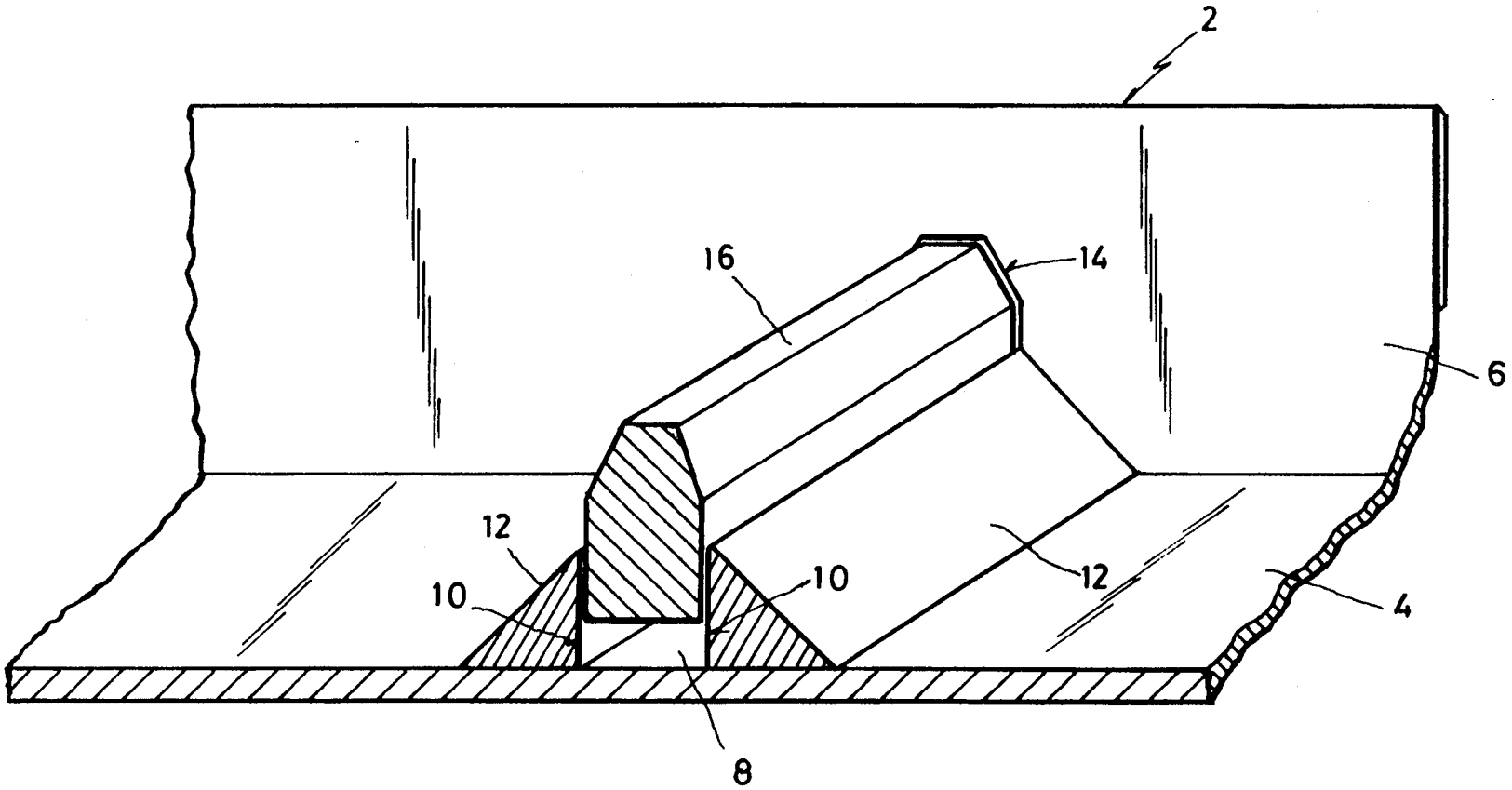
FIG. 3 is a perspective view of a section of the mold on a longitudinal plane.

According to a preferred embodiment, the height of the strips 16 is smaller than the height of the windows 14 and the strips are longer than the grooves 8. Therefore, the strips are adapted to project through both windows 14 of one same groove. Furthermore, they may be moved vertically from a lowered position in which the strip rests on the bottom 4 and a raised position in which the strip 16 contacts the upper profile of the window; this is the position shown in FIGS. 2 and 3.

There is contemplated an external horizontal tab 18 (FIG. 2) extending from each side wall 6 and which may be continuous or not. A spacer 20 capable of being supported on said tab 18 is a raising means for holding the strip in the above mentioned raised position, although the invention also comprises other conventional raising or holding means, such as pins or the like.

The arrangement described in the foregoing paragraphs allows the molding work to be simplified, by operating as follows.

A strip 16 is inserted through a window 14 until it fills the groove 8. Thereafter the strip is placed in the raised position by way of the spacers 20. After the concrete has set, the spacers 20 are removed and the strip 16 drops, either alone or by being pressed down, whereby it becomes released from the concrete precasting without the latter having suffered from appreciable stress.

The invention also contemplates another embodiment (FIG. 4) in which the groove 8 is a through slot and is provided with rules 30 adapted to penetrate in the mold through said through slots. Preferably these rules are adapted to be attached to a lever 32 or other mechanical means capable of facilitating the insertion and, more particularly, the removal of the rule 30 from inside the mold.

The operation of these rule 30 is obvious from the above explanation and it is pointed out that the prior removal thereof also avoids the appearance of stress in the stripping of the concrete precasting from the mold.

In a further embodiment (FIG. 5), it is contemplated that the strip has a rib 22 (or a not shown channel) extending substantially all along the strip, although it may also be intermittent, or simply be one or several bosses or spigots.

Furthermore, the invention also comprises separators 24, possibly provided with gripping means 26. These separators 24 have the same or a greater height than the side walls 6 and the purpose thereof is to provide separate pieces between each pair of grooves 8.

The separators 24 may be fitted in the groove itself (embodiment not shown) or may be attached to a strip 16 by way of a channel 28 (or rib not shown) mating with the rib 22 (or corresponding channel).

Figure 5:
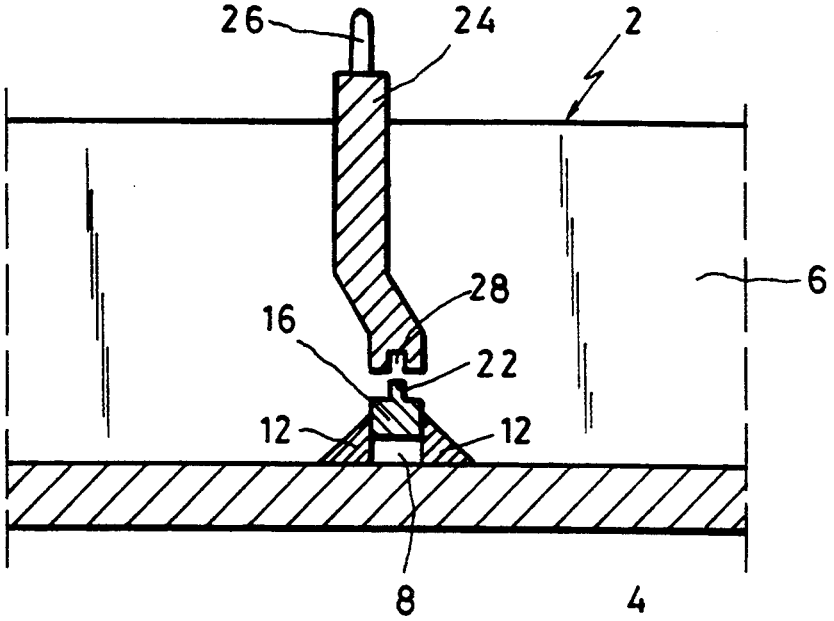
FIG. 5 is a partial schematic showing a strip and a spacer.

The way of operation with the members just described is as follows. The strip 16 is arranged in the groove 8 and is placed in the raised position, as shown in FIG. 5. Thereafter, the separator 24 is attached, in such a way that the corresponding ribs and channels mate; the mold is filled with concrete and after setting it is stripped preferably in the following order: the strip 16 is lowered; the piece located in the Figure at the right of the separator is separated; the separator is removed and finally the piece located to the left in the Figure is removed from the mold. As required, the same order is followed for successive pieces placed further to the left of the last one considered.

The only purpose of the reference symbols inserted after the technical features mentioned in the claims is to facilitate the intelligibility of the latter and not to restrict the scope thereof in any way.

What I claim is:

1. A mold for concrete modular precastings comprising:

a bottom;

containment side walls;

a plurality of grooves formed in said bottom and extending crosswise between opposing side walls;

windows formed in each of said opposing side walls as extensions of each groove and having an upper profile;

strips constructed and arranged for insertion into and extending upwardly from said grooves, wherein said strips extend outwardly through said windows and have a height less than the dimension of the window in a direction perpendicular to the mold bottom, each strip being adapted to move in said perpendicular direction within said grooves and windows, between a lowered position in which each strip rests against a bottom of a respective one of said grooves and a raised position in which each strip engages said upper profile of the window; and means for locking the strips in the raised position.

2. The mold of claim 1, wherein each groove is delimited by facing faces of respective fillets fixedly attached to the mold bottom and which are arranged mutually spaced apart and parallel to one another.

3. The mold of claim 2, wherein each fillet is of triangular prismatic shape, the cross section thereof being a right-angled triangle.

4. The mold of claim 1, wherein the dimension of the window, in the direction perpendicular to the mold bottom, is greater than the depth of the groove.

5. The mold of claim 1, wherein the height of said strips is greater than the depth of the grooves.

6. The mold of claim 1, wherein said strips are longer than the grooves and project out through said windows.

7. The mold of claim 1, being provided with external horizontal tabs extending from each side wall and said means for locking are spacers adapted to rest against said tabs.

8. The mold of claim 5, wherein said strips are provided with an irregular top extending the length of the strip, the irregular top being at least one of a channel and a rib.

9. The mold of claim 1, further comprising separators adapted to engage in said grooves.

10. The mold of claim 8, further comprising separators adapted to engage in said irregular top of the strips.

11. The mold of claim 10, wherein the height of said separators is equal to or greater than the height of said side walls.

12. The mold of claim 1, wherein said grooves are through slots and there are rules adapted to be inserted in the mold through the slots.

13. The mold of claim 12, further comprising lever means for facilitating the insertion and removal of the rules into and out of the mold.

14. The mold of claim 8 wherein the irregular top includes at least one channel and at least one rib which extend intermittently the length of the irregular top.

* * * * *